United States Patent [19]

Conner

[11] Patent Number: 4,946,033

[45] Date of Patent: Aug. 7, 1990

[54] SKIN CLEANER/TOWEL PACKAGE

[76] Inventor: Bruce E. Conner, 11-A Sachem St., Lynn, Mass. 01902

[21] Appl. No.: 403,061

[22] Filed: Sep. 5, 1989

Related U.S. Application Data

[63] Continuation-in-part of Ser. No. 275,939, Nov. 25, 1988, abandoned.

[51] Int. Cl.[5] ..... B65D 75/34; B65D 75/52

[52] U.S. Cl. ..... 206/223; 206/38

[58] Field of Search ..... 206/223, 229, 484, 581, 206/812, 216, 38

[56] References Cited

U.S. PATENT DOCUMENTS

| | | | |
|---|---|---|---|
| 2,047,745 | 7/1936 | Poppe . | |
| 2,333,587 | 11/1943 | Salfisberg | 206/484 |
| 2,401,110 | 5/1946 | Rohdin . | |
| 3,156,355 | 11/1964 | Rodgers . | |
| 3,534,887 | 10/1970 | Ginsberg | 206/812 |
| 3,650,461 | 3/1972 | Hutcheson . | |
| 3,983,994 | 10/1976 | Wyslotsky | 206/484 |
| 4,007,838 | 2/1977 | Awad | 206/812 |
| 4,201,031 | 5/1980 | Wiles | 53/455 |
| 4,220,244 | 9/1980 | Elmore | 206/210 |
| 4,301,923 | 11/1981 | Vuorento | 206/484 |
| 4,312,473 | 1/1982 | Hoeller . | |
| 4,332,319 | 6/1982 | Hurwood | 206/812 |
| 4,427,115 | 1/1984 | Laipply | 206/484 |
| 4,702,378 | 10/1987 | Finker et al. | 206/581 |
| 4,718,556 | 1/1988 | Hildebrandt | 206/604 |
| 4,749,080 | 6/1988 | Toohey | 206/210 |
| 4,796,751 | 1/1989 | Madkuur | 206/812 |

FOREIGN PATENT DOCUMENTS

| | | | |
|---|---|---|---|
| 2717128 | 11/1978 | Fed. Rep. of Germany | 206/38 |
| 2914590 | 12/1978 | Fed. Rep. of Germany | 206/812 |
| 2737425 | 3/1979 | Fed. Rep. of Germany | 206/812 |
| 2142895 | 1/1985 | United Kingdom | 206/812 |

*Primary Examiner*—William Price

[57] ABSTRACT

A convenient, portable, single use package providing method of a cleanup of grease or grime in when conventional means are not available. The pouch 20 contains a cleaning composition 28 which after application on the hands or skin, is removed from under and around the nails by a scraping implement 42 and the remainder of the cleaning composition 20 is removed by a towel 26 provided in the pouch thus leaving the hands clean.

20 Claims, 9 Drawing Sheets

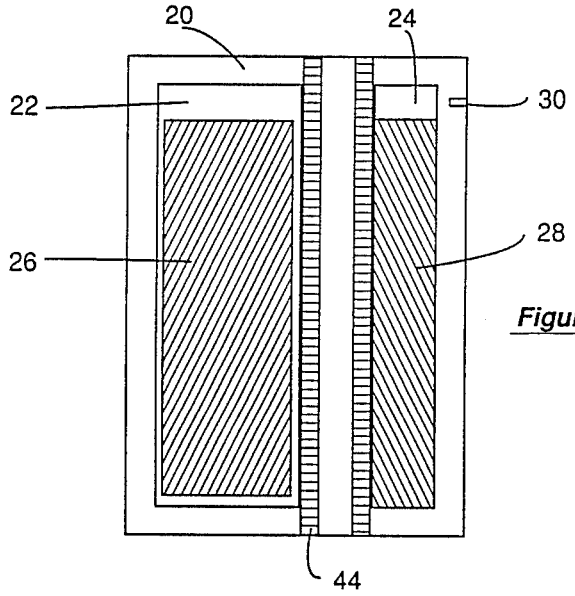
Figure 11
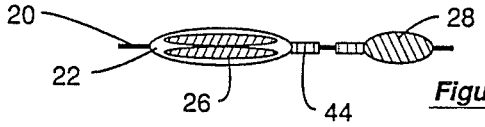
Figure 12
Figure 13
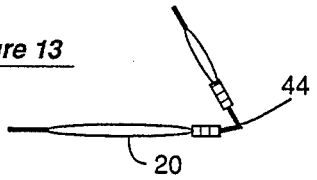

SKIN CLEANER/TOWEL PACKAGE

This is a continuation-in-part of application Ser. No. 275939, filed 11/25/88. Original application is now abandoned.

BACKGROUND—FIELD OF INVENTION

This invention relates to packaging methods, specifically to an improved packaging method for a skin cleaning system.

BACKGROUND—DESCRIPTION OF PRIOR ART

Removal of heavy grime from hands is a problem for persons who may have occasion to get dirty far from home or shop where cleanup is not readily available. At present there are no convenient single use skin cleaning systems or packages available for cleanup of heavy grime or grease.

Individually packaged pre-moistened towels are good for removing very light soil or stickiness, but are ineffective for removing heavy grime or grease. They are not a substitute for a cleaner which can be worked into the skin.

So called "waterless" skin cleaners are very useful in removing grime, but generally are packaged either in rather large cans or in wall mounted dispensers, niether of which is convenient for carrying in a pocket or glove box.

Compounds known as "waterless skincleaners" generally consisting of a petroleum distillate base or a gylcol base plus gelling agents, nonoxynol compounds, Cellulose gum, and the like are made specifically for the purpose of removing heavy deposits of grime, piant, oil, grease, etc. The term "waterless" does not refer to a non-aqueous compound, but rather to the fact that the skincleaner can be used to clean the skin without use of water as a rinsing agent. Additionally, some method of removing the cleaner from the skin is necessary. This can either be by washing off with water, or by wiping off with a paper or cloth towel. Again, neither a sink nor a roll of paper towels is really portable.

Additionally, a method of removal of cleaner and/or grime from under and around the nails or other inaccessible places is necessary. This can be accomplished by use of an implement of sufficient ridgidity and of proper dimensions to scrape the unwanted matter away.

Therefore, it would be desirable to have a convenient, portable, single use package containing all necessary articles for removal of heavy grime and grease from the skin and nails.

OBJECTS AND ADVANTAGES

Accordingly I claim the following as objects and advantages of the invention: To provide a convenient, single use, portable, which contains all necessary components for cleaning soiled skin and nails, to provide a packaging method which physically segregates the components contained in the package, to provide a measured amount of cleaning composition for the purpose of removing soil from the skin, to provide a scraping implement for removal of material from under and around the nails or other areas of skins, to provide a towel for the subsequent removal of the cleaning composition from the skin.

Readers will find further objects and advantages from a consideration of the ensuing description and the accompanying drawings.

DRAWING FIGURES

FIG. 11 shows a front view of the fifth embodiment of the invention.

FIG. 12 shows a top view of the fifth embodiment of the invention.

FIG. 13 shows a top view of the fifth embodiment of the invention in the fifthary position.

DRAWING REFENCE NUMERALS

Figure 1:
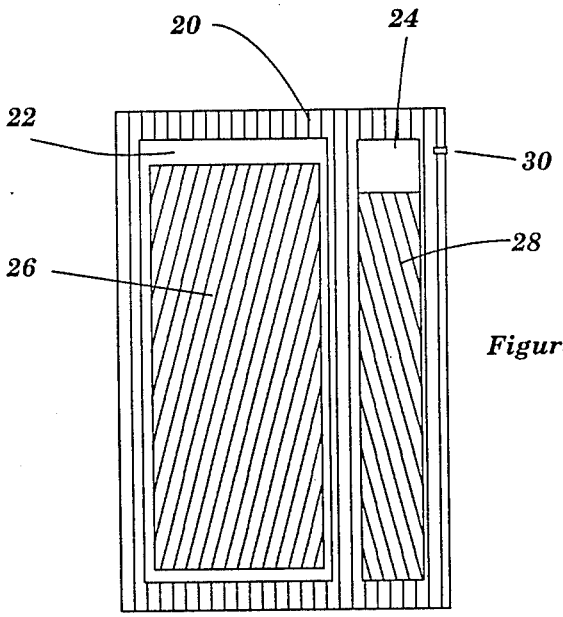
FIG. 1 shows a front view of the first embodiment of the invention.

20 package/pouch of the first embodiment having vertical seam
22 compartment for towel
24 compartment for cleaning composition
26 towel
28 cleaning composition
30 cut or notch to facilitate opening of pouch by tearing
32 seam to segregate 22 from 24
34 package/pouch of the second embodiment with single compartment 22
36 package/pouch of the second embodiment with single compartment 24
38 vertical seam joining 34 and 36
40 package/pouch of the third embodiment having a horizontal seam
42 scraping implement formed on or attached to edge of pouch 20 to clean under and around nails
44 double seam with space between seams to initiate fold in pouch 20

48 notch in edge of pouch 20 to initiate fold in pouch 20
50 ridgid element running parallel to seam 32
52 compartment for scraping implement
54 removable scraping implement

SKIN CLEANER/TOWEL PACKAGE—DESCRIPTION

Figure 2:
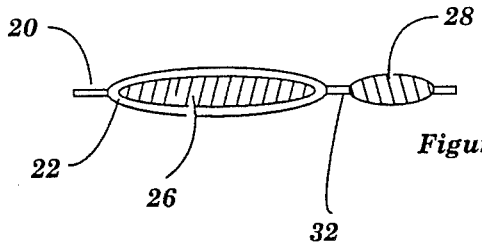
FIG. 2 shows a sectional top view of the first embodiment of the invention.

Figure 1 shows a front view of a skin cleaner/towel package according to the first embodiment of the invention. The package comprises a pouch 20 made of paper, plastic, foil, or the like sealed on all outside edges, which contains two compartments 22 and 24. Compartment 24 contains a skin cleaning composition 28 of a solid, liquid, paste or like nature. Compartment 22 contains a towel 26 made of paper, cloth or other absorbent material for the removal of the skin cleaning compound. The physcial separation of the compartments 22 and 24 is accomplished by a vertical seam 32 which runs the length of the package. A notch or cut 30 provides a point whereby a tear may be initiated for removing the top of pouch 20, thus opening compartments 22 and 24 and exposing towel 26 and skin cleaning composition 28 for use. FIG. 2 shows a sectional top view of the first embodiment of the invention. The vertical seam 32 is shown separating the compartments 22 and 24.

Figure 3:
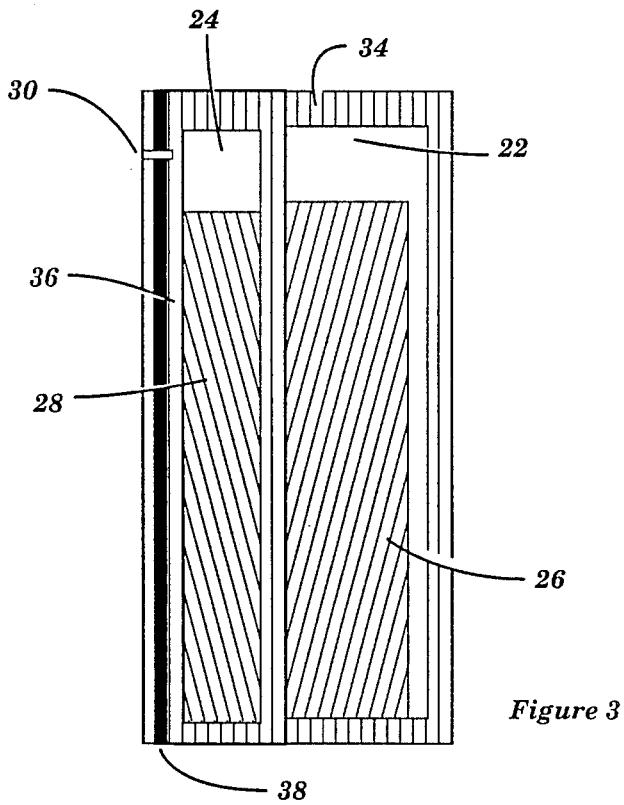
FIG. 3 shows a front view of the second embodiment of the invention.

FIG. 3 shows a front view of a skin cleaner/towel package according to the second embodiment of the invention. This embodiment comprises two separately produced pouches 34 and 36 made of paper, plastic, foil, or the like sealed on all outside edges, which are joined by seam 38 to form a single unit.

Figure 4:
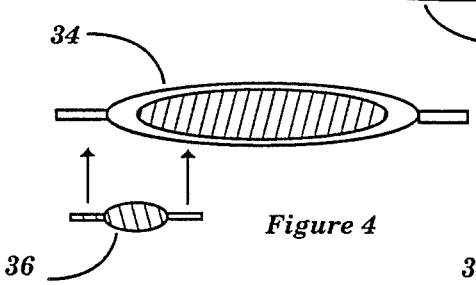
FIG. 4 shows a sectional top view of the second embodiment of the invention indicating the first method of attachment of its components.

FIG. 4 shows a sectionalized top view of the second embodiment as described in FIG. 3 demonstrating a possible configuration of the unit wherein pouches 34 and 36 are totally overlapping being joined by seam 38.

Figure 5:
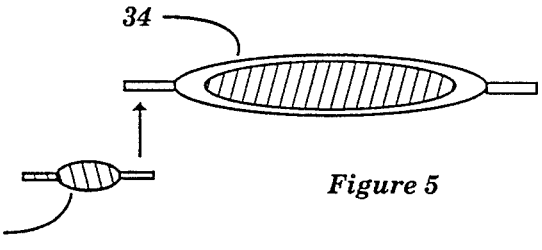
FIG. 5 shows a sectional top view of the second embodiment of the invention indicating the second method of attachment of its components.

FIG. 5 shows a sectionalized top view of the second embodiment as described in FIG. 3 demonstrating a possible configuration of the unit wherein pouches 34 and 36 are joined by seam 38 with only one edge of pouches 34 and 36 overlapping.

Figure 6:
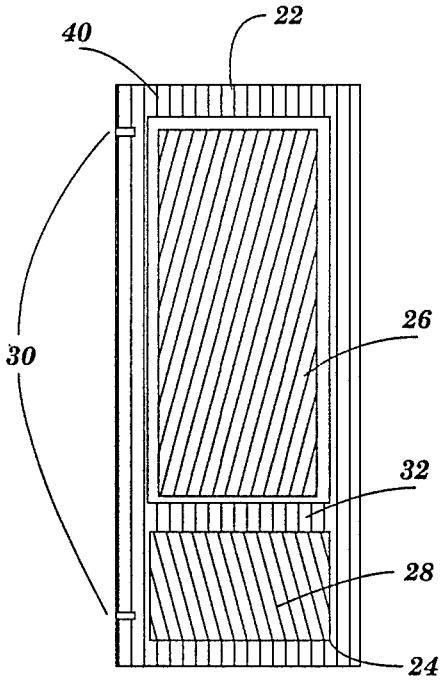
FIG. 6 shows a front view of the third embodiment of the invention.

FIG. 6 shows a front view of a skin cleaner/towel package according to the third embodiment of the invention. This embodiment comprises a pouch 40 made of paper, plastic, foil, or the like sealed on all outside edges, which contains two compartments 22 and 24 separated by a horizontal seam 32. The notch or cut 30 is made at each end of the pouch so that the ends of said pouch may be torn off, thus exposing the contents of compartments 22 and 24 for use.

Figure 7:
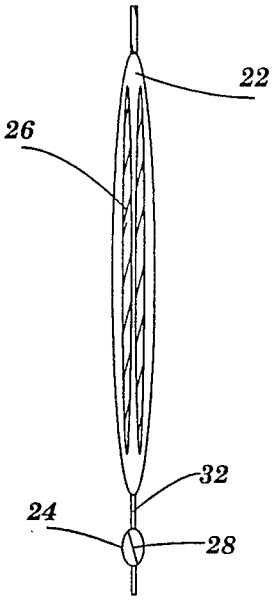
FIG. 7 shows a sectional side view of the third embodiment of the invention.

FIG. 7 is a sectionalized side view of the third embodiment as shown in FIG. 6 showing the separation of compartments 22 and 24 by seam 32.

Figure 8:
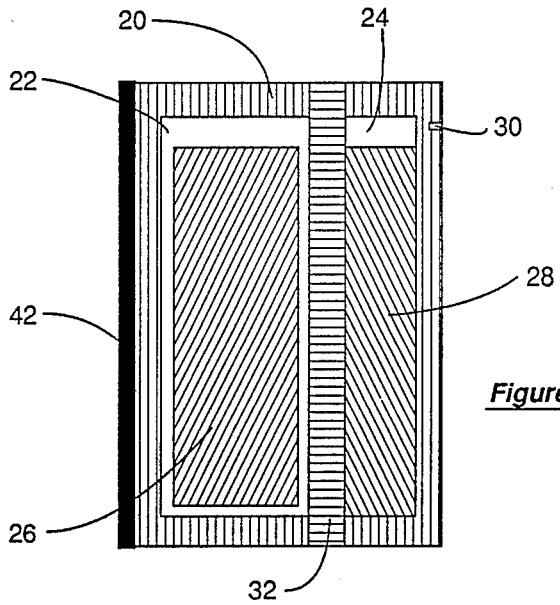
FIG. 8 shows a front view of the fourth embodiment of the invention.

FIG. 8 shows a front view of a skin cleaner/towel package according to the fourth embodiment of the invention. The package comprises a pouch 20 made of paper, plastic, foil, or the like sealed on all outside edges, which contains two compartments 22 and 24. Compartment 24 contains a skin cleaning composition 28 of a solid, liquid, paste or like nature. Compartment 22 contains a towel 26 made of paper, cloth or other absorbent material for the removal of the skin cleaning compound. The physical separation of the compartments 22 and 24 is accomplished by a vertical seam 32 which runs the length of the package. A notch or cut 30 provides a point whereby a tear may be initiated for removing the top of pouch 20, thus opening compartments 22 and 24 and exposing towel 26 and skin cleaning composition 28 for use. A scraping implement 42 is formed on the edge of pouch 20 or attached to edge of pouch 20.

Figure 9:
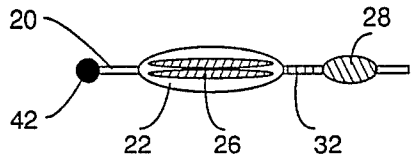
FIG. 9 shows a sectional top view of the fourth embodiment of the invention.

FIG. 9 shows a sectional top view of the fourth embodiment of the invention. The vertical seam 32 is shown separating the compartments 22 and 24. The scraping implement 42 is also shown.

Figure 10:
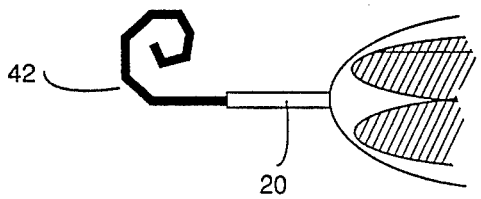
FIG. 10 shows a detail of top view of the fourth embodiment of the invention showing one possible method of forming edge.

FIG. 10 shows a detail of sectional top view shown in FIG. 9 showing scraping implement 42 as formed by rolling edge of pouch 20.

FIG. 11 shows a front view of a skin cleaner/towel package according to the fifth embodiment of the invention. The package comprises a pouch 20 made of paper, plastic, foil, or the like sealed on all outside edges, which contains two compartments 22 and 24. Compartment 24 contains a skin cleaning composition 28 of a solid, liquid, paste or like nature. Compartment 22 contains a towel 26 made of paper, cloth or other absorbent material for the removal of the skin cleaning compound. The physical separation of the compartments 22 and 24 is accomplished by a double seam 44 which runs the length of the package. The double seam has a space between the two seams which facilitates folding along length of double seam 44. A notch or cut 30 provides a point whereby a tear may be initiated for removing the top of pouch 20, thus opening compartments 22 and 24 and exposing towel 26 and skin cleaning composition 28 for use.

FIG. 12 shows a sectional top view of the fifth embodiment of the invention showing double seam 44.

FIG. 13 shows a sectional top view of the fifth embodiment of the invention showing the pouch 20 in the folded position. The pouch 20 is folded along double seam 44.

Figure 14:
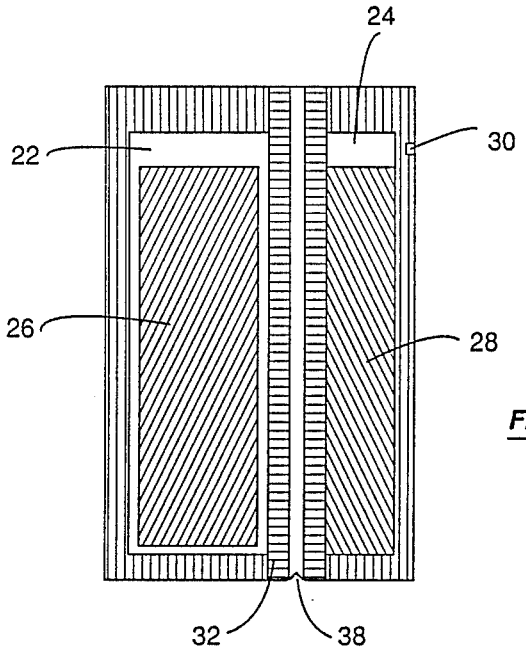
FIG. 14 shows a front view of the sixth embodiment of the invention.

FIG. 14 shows a front view of the sixth embodiment of the invention having a notch 38 cut into edge of seam 32 to form a point of fold initiation along seam 32. The seam 32, when folded forms a rigid scraping implement.

Figure 15:
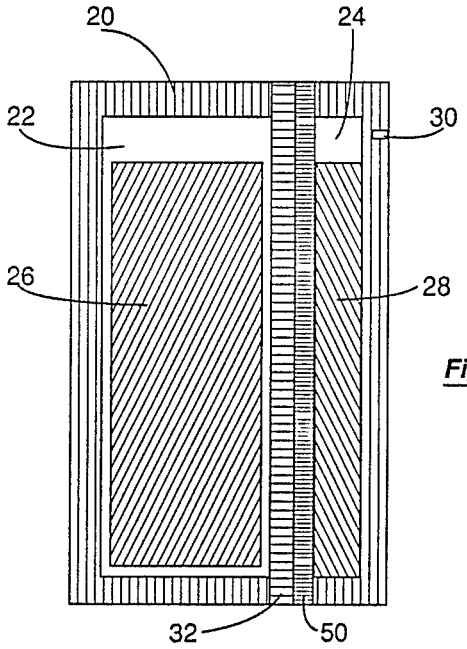
FIG. 15 shows a front view of the seventh embodiment of the invention.

FIG. 15 shows a front view of the seventh embodiment of the invention showing a rigid element 50 which runs parallel to seam 32 such that the pouch 20 can be folded along the intersection of seam 32 and ridgid element 50 forming a scraping implement.

Figure 16:
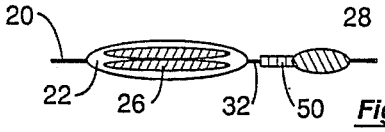
FIG. 16 shows a top view of the seventh embodiment of the invention.

FIG. 16 shows a sectional top view showing location of rigid element 50 in relation to seam 32.

Figure 17:
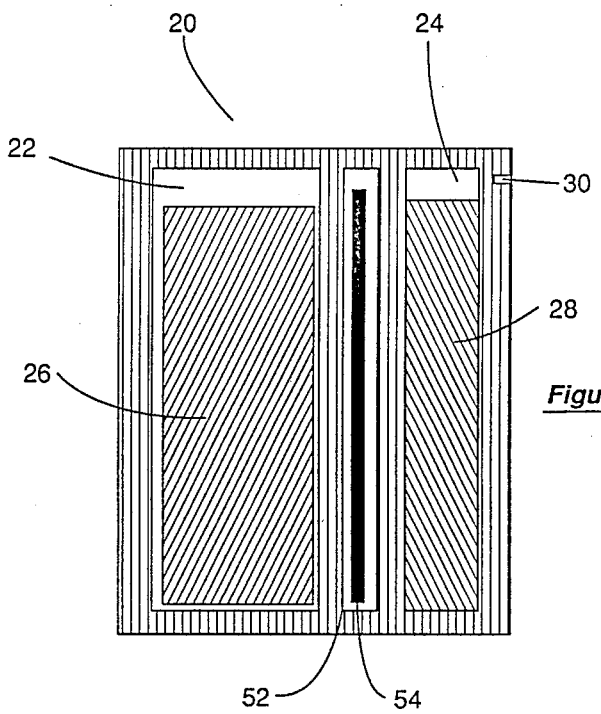
FIG. 17 shows a front view of the eighth embodiment of the invention.

FIG. 17 shows a front view of the eigth embodiment of the invention having a compartment 52 containing a removable scraping implement 54.

Figure 18:
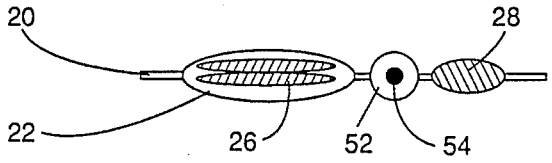
FIG. 18 shows a top view of the eighth embodiment of the invention.

FIG. 18 shows a sectional top view of the eighth embodiment of the invention showing location of compartment 52 and removable scraping implement 54.

Figure 19:
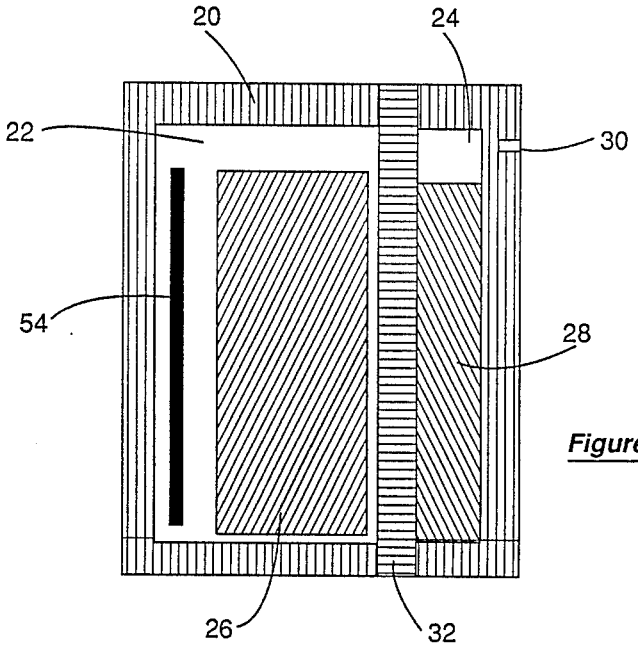
FIG. 19 shows a front view of the ninth embodiment of the invention.

FIG. 19 shows a front view of the ninth embodiment of the invention. The removable scraping implement 54 is located in compartment 22 along with towel 26.

SKIN CLEANER/TOWEL PACKAGE—OPERATION

The skin cleaner/towel package of FIG. 1 provides a portable and convenient method of cleanup of grease or grime when conventional means are not available. The package is opened by tearing the top off the pouch 20, exposing the contents. The cleaning composition 28 is dispensed onto the hands and worked until the grime is loosened. When this has been accomplished, the towel 26 is used to remove the grime and cleaning compound, leaving the hands clean. The operation of all embodiments of the invention is substantially the same.

The skin cleaner/towel package of FIG. 8 provides a portable and convenient method of cleanup of grease or grime when conventional means are not available. The package is opened by tearing the top off the pouch 20, exposing the contents. The cleaning composition 28 is dispensed onto the hands and worked until the grime is loosened. When this has been accomplished, the scraping implement 42 is used to remove material from under and around the nails, then the towel 26 is used to remove the grime and cleaning compound, leaving the hands clean.

The skin cleaner/towel package of FIG. 11 is opened by tearing the top off the pouch 20, exposing the contents. The cleaning composition 28 is dispensed onto the hands and worked until the grime is loosened. When this has been accomplished, the pouch 20 is folded along the line formed between the double seam 44 to form a scraping implement at the lower edged of the pouch 20. The scraping implement is used to remove material from under and around the nails, then the towel 26 is used to remove the grime and cleaning compound, leaving the hands clean.

The skin cleaner/towel packaged of FIG. 14 is opened by tearing the top off the pouch 20, exposing the contents. The cleaning composition 28 is dispensed onto the hands and worked until the grime is loosened. When this has been accomplished, the pouch 20 is folded along the seam 32 at the point of the notch 38 to form a scraping implement at the lower edge of the pouch 20. The scraping implement is used to remove material from under and around the nails, then the towel 26 is used to remove the grime and cleaning compound, leaving the hands clean.

The skin cleaner/towel package of FIG. 15 is opened by tearing the top off the pouch 20, exposing the contents. The cleaning composition 28 is dispensed onto the hands and worked until the grime is loosened. When this has been accomplished, the pouch 20 is folded along the line formed between the seam 32 and the ridgid element 50 to form a scraping implement at the lower edged of the pouch 20. The scraping implement is used to remove material from under and around the nails, then the towel 26 is used to remove the grime and cleaning compound, leaving the hands clean.

The skin cleaner/towel package of FIG. 17 provides a portable and convenient method of cleanup of grease or grime when conventional means are not available. The package is opened by tearing the top off the pouch 20, exposing the contents. The cleaning composition 28 is dispensed onto the hands and worked until the grime is loosened. When this has been accomplished, the removable scraping implement 54 is used to remove material from under and around the nails, then the towel 26 is used to remove the grime and cleaning compound, leaving the hands clean.

SUMMARY

While the above description contains many specificities, the reader should not construe these as limitations on the scope of the invention, but merely as exemplifications of the preferred embodiments thereof. Those skilled in the art will envision many other possible variations are within its scope. For example skilled artisans will readily be able to change the dimensions and shapes of the various embodiments. They will be able to change the shape or capacities of the compartments. They will be able to employ various types of cleaning compositions and various types of towel materials. Accordingly the reader is requested to determine the scope of the invention by the appended claims and their legal eqivalents, and not by the examples given.

We claim:

1. A convenient, single use, portable package comprising:

a pouch comprising superposed layers of packaging material, said layers forming between them compartments, at least one margin of which is formed by a sealing flange in which the edge portions are sealed together;

said pouch comprising a plurality of compartments providing a means of physical segregation of components contained therein;

said pouch wherein one or more edges of said pouch comprises a scraping means whereby the user can scrape areas of skin and nails which could prove otherwise inconvenient or inaccessable.

2. Pouch described in claim 1 wherein said scraping means is a separate element attached externally to edge of said pouch.

3. Pouch described in claim 1 wherein said scraping means is produced on the edge of said pouch by forming said forming said edge by heat or other means suitable to produce a raised or thickened edge suitable for the purpose described in claim 1.

4. Pouch described in claim 1 wherein said scraping means is produced on the edge of said pouch by forming said edge by heat or other means wherein said edge is rolled or folded to form a thickened edge of sufficient ridgidity to act as said scraping means described in claim 1.

5. Pouch described in claim 1 comprising a plurality of compartments one of which contains a so-called "waterless" skincleaning composition, solution, paste, cream or the like;

said pouch comprising a plurality of compartments one of which contains a means of removing the aforesaid cleaning composition after use of said cleaning composition.

6. Pouch described in claim 1 containing a towel or towels made of paper, cloth, or other absorbent material.

7. A convenient, single use, portable package comprising:

a pouch comprising superposed layers of packaging material, said layers forming between them compartments, at least one margin of which is formed by a sealing flange in which the edge portions are sealed together;

said pouch comprising a plurality of compartments providing a means of physical segreation of components contained therein;

said pouch wherein a scraping means is formed by folding said pouch to produce sufficient ridgidity whereby the user can scrape areas of skin and nails which could prove otherwise inconvenient or inacessable.

8. Pouch described in claim 7 wherein the fold means for forming said scraper is delineated by forming a double seam down the interior of the pouch, said double seam having a sufficient space between said seams to facillitate folding along line between said seams.

9. Pouch described in claim 7 wherein the fold means for forming said scraping means is delineated by a notch means located in edge of said pouch, said notch means providing a fold initiating means and providing an improved support for edge of said scraping means by virtue of the angle produced.

10. Pouch described in claim 7 wherein the fold means for forming said scraping means is facilitated by embossing material of said pouch to form a fold initiation line.

11. Pouch described in claim 7 wherein said scraping means is formed by addition of material to center seam of said pouch providing a thickened area whereby the fold means is deleneated by the margin of said thickened area.

12. Pouch described in claim 7 comprising a plurality of compartments one of which contains a so-called "waterless" skincleaning composition, solution, paste, cream or the like;

said pouch comprising a plurality of compartments one of which contains a means of removing the aforesaid cleaning composition after use of said cleaning composition.

13. Pouch described in claim 7 containing a towel or towels made of paper, cloth, or other absorbent material.

14. A convenient, single use, portable package comprising:

a pouch comprising superposed layers of packaging material, said layers forming between them compartments, at least one margin of which is formed by a sealing flange in which the the edge portions are sealed together;

said pouch comprising a plurality of compartments providing a means of physcial segregation of components contained therein;

said pouch comprising a plurality of compartments one of which contains a removable scraping means whereby the user can scrape areas of skin and nails otherwise inaccessable.

15. Pouch as described in claim 14 wherein said pouch has a separate compartment means containing said scraping means.

16. Pouch described in claim 14 comprising a plurality of compartments one of which contains a so-called "waterless" skincleaning composition, solution, paste, cream or the like;

said pouch comprising a plurality of compartments one of which contains a means of removing the aforesaid cleaning composition after use of said cleaning composition.

17. Pouch described in claim 14 wherein said scraping means is placed in the same compartment with a towel or towels made of paper, cloth or other absorbent material.

18. Pouch described in claim 1 wherein the packaging material is a polymer film.

19. Pouch described in claim 7 wherein the packaging material is a polymer film.

20. Pouch described in claim 14 wherein the packaging material is a polymer film.

* * * * *